US011946013B2

(12) United States Patent
Nakahara et al.

(10) Patent No.: US 11,946,013 B2
(45) Date of Patent: Apr. 2, 2024

(54) LUBRICANT COMPOSITION

(71) Applicant: Idemitsu Kosan Co., Ltd., Chiyoda-ku (JP)

(72) Inventors: Yasuhito Nakahara, Tokyo (JP); Hiroyuki Tatsumi, Tokyo (JP); Keiichi Narita, Tokyo (JP); Koki Ito, Tokyo (JP)

(73) Assignee: Idemitsu Kosan Co., Ltd., Chiyoda-ku (JP)

( * ) Notice: Subject to any disclaimer, the term of this patent is extended or adjusted under 35 U.S.C. 154(b) by 0 days.

(21) Appl. No.: 17/792,362

(22) PCT Filed: Jan. 15, 2021

(86) PCT No.: PCT/JP2021/001167
§ 371 (c)(1),
(2) Date: Jul. 12, 2022

(87) PCT Pub. No.: WO2021/145405
PCT Pub. Date: Jul. 22, 2021

(65) Prior Publication Data

US 2023/0039111 A1 Feb. 9, 2023

(30) Foreign Application Priority Data

Jan. 15, 2020 (JP) ..... 2020-004703

(51) Int. Cl.

| | |
|---|---|
| ***C10M 131/04*** | (2006.01) |
| ***C10M 101/02*** | (2006.01) |
| ***C10M 169/04*** | (2006.01) |
| *C10N 20/02* | (2006.01) |
| *C10N 40/04* | (2006.01) |

(52) U.S. Cl.
CPC ..... *C10M 131/04* (2013.01); *C10M 101/02* (2013.01); *C10M 169/04* (2013.01); *C10M 2203/003* (2013.01); *C10M 2211/022* (2013.01); *C10N 2020/02* (2013.01); *C10N 2040/042* (2020.05); *C10N 2040/045* (2020.05)

(58) Field of Classification Search
CPC C10M 131/04; C10M 101/02; C10M 169/04; C10M 2203/003; C10M 2211/022; C10N 2020/02; C10N 2040/042; C10N 2040/045
See application file for complete search history.

(56) References Cited

U.S. PATENT DOCUMENTS

| | | | | |
|---|---|---|---|---|
| 4,983,313 | A | 1/1991 | Kaneko et al. | |
| 5,417,872 | A * | 5/1995 | Fukuda | C10M 105/32 508/304 |
| 5,866,030 | A * | 2/1999 | Reyes-Gavilan | C10M 129/08 508/588 |
| 6,299,792 | B1 * | 10/2001 | Feiring | C09K 5/045 252/68 |
| 6,374,629 | B1 * | 4/2002 | Oberle | C10M 171/008 62/502 |
| 2003/0062508 | A1 * | 4/2003 | Singh | C09K 5/045 252/67 |
| 2003/0209688 | A1 * | 11/2003 | Lee | C10M 101/02 252/68 |
| 2004/0209786 | A1 | 10/2004 | Sagawa et al. | |
| 2008/0058233 | A1 | 3/2008 | Sagawa et al. | |
| 2011/0092402 | A1 | 4/2011 | Sagawa et al. | |
| 2015/0252281 | A1 | 9/2015 | Saito et al. | |
| 2017/0321099 | A1 * | 11/2017 | Sethi | F25B 31/002 |
| 2020/0017795 | A1 * | 1/2020 | Saito | C10M 111/04 |
| 2020/0248095 | A1 * | 8/2020 | Guerin | C10M 169/041 |
| 2021/0139805 | A1 * | 5/2021 | Champagne | H01M 10/0525 |
| 2022/0106538 | A1 * | 4/2022 | Shono | C09K 5/04 |
| 2022/0298448 | A1 * | 9/2022 | Shono | C10M 171/008 |
| 2022/0411710 | A1 * | 12/2022 | Shono | C10M 129/56 |

FOREIGN PATENT DOCUMENTS

| | | | |
|---|---|---|---|
| CN | 104204163 | A | 12/2014 |
| CN | 104520415 | A | 4/2015 |
| CN | 105008501 | A | 10/2015 |
| CN | 108699482 | A | 10/2018 |
| JP | 49-32199 | | 3/1974 |
| JP | 2-255797 | A | 10/1990 |
| JP | 8-253780 | A | 10/1996 |
| JP | 2008-266656 | A | 11/2008 |
| JP | 2009-242547 | A | 10/2009 |
| JP | 2010-132792 | A | 6/2010 |
| JP | 2012-184360 | A | 9/2012 |
| JP | 2012-197326 | A | 10/2012 |
| WO | WO 02/097017 | A1 | 12/2002 |
| WO | WO 2014/034568 | A1 | 3/2014 |

OTHER PUBLICATIONS

International Search Report dated Mar. 2, 2021 in PCT/JP2021/001167 filed Jan. 15, 2021, 3 pages.
Combined Chinese Office Action and Search Report dated May 15, 2023, in corresponding Chinese Patent Application No. 202180007950.5 (with English Translation of Category of Cited Documents), 13 pages.

* cited by examiner

*Primary Examiner* — Ellen M McAvoy
(74) *Attorney, Agent, or Firm* — Oblon, McClelland, Maier & Neustadt, L.L.P.

(57) ABSTRACT

A lubricating oil composition which contains a base oil and a fluorine compound and may have improved cooling performance. The base oil may contain a mineral oil. The base oil may have a kinematic viscosity in a range of from 1 to 25 $mm^2/s$ at 40° C. The content of the fluorine compound may be in a range of from 3 to 30% by weight based on the total amount of the composition.

20 Claims, No Drawings

LUBRICANT COMPOSITION

CROSS-REFERENCE TO RELATED APPLICATIONS

The present application is the national stage of international application PCT/JP2021/001167, filed on Jan. 15, 2021, and claims the benefit of the filing date of Japanese Appl. No. 2020-004703, filed on Jan. 15, 2020.

TECHNICAL FIELD

The present invention relates to a lubricating oil composition, and for example, to a lubricating oil composition used in the cooling of apparatuses for electric vehicles.

BACKGROUND ART

In recent years, there has been a strong demand for reduction in carbon dioxide emission, from the viewpoint of protecting the global environment. Also, in the automotive field, efforts have been made to develop a fuel-saving technique, and hybrid vehicles and electric vehicles that are automobiles excellent in terms of fuel economy and environmental performance have been widely diffused. Such hybrid vehicles and electric vehicles are equipped with electric motors, generators, inverters, storage batteries, etc., and these automobiles drive by utilizing the force of such electric motors.

Since apparatuses for electric vehicles, such as electric motors or batteries, incur efficiency reduction or corruption under high-temperature conditions, the cooling of the apparatuses for electric vehicles is necessary. For the cooling of electric motors or generators used in hybrid vehicles or electric vehicles, existing lubricating oils such as an automatic transmission fluid (hereinafter referred to as "ATF") or a continuously variable transmission fluid (hereinafter referred to as "CVTF") have been mainly used. In addition, since there are hybrid vehicles or electric vehicles, which have gear speed reducers, a lubricating oil composition used in these automobiles needs to have coolability as well as lubricity.

Examples of the cooling performance of a lubricating oil composition may include: high density and low viscosity required for cooling to decrease the temperatures of various apparatuses, and high flash point required for preventing the firing of various apparatuses during cooling. Among them, since low viscosity and high flash point generally have a trade-off relationship, these are characteristics that are difficult to keep balance. Thus, studies have been conducted to achieve both low viscosity and high flash point.

For example, Patent Literature 1 proposes a lubricating oil composition prepared by mixing a fluorine compound into a synthetic oil, as a lubricating oil composition comprising coolability and lubricity.

CITATION LIST

Patent Literature

Patent Literature 1: JP Patent Publication (Kokai) No. 2012-184360 A

SUMMARY OF INVENTION

Under such circumstances, it has been desired to develop a lubricating oil composition that is excellent in terms of cooling performance and the like.

The present invention relates to a lubricating oil composition comprising a base oil and a fluorine compound, and a cooling device comprising the lubricating oil composition.

One embodiment of the present invention relates to a lubricating oil composition comprising a base oil and a fluorine compound, wherein the base oil comprises a mineral oil, the kinematic viscosity of the base oil at 40° C. is 1 to 25 $mm^2/s$, and the content of the fluorine compound is 3% to 30% by weight based on the total weight of the composition.

According to the present invention, a lubricating oil composition having excellent cooling performance can be provided.

The lubricating oil composition of the present invention is excellent in terms of compatibility of a base oil and a fluorine compound, and thus, separation of them is suppressed.

In a preferred aspect, a lubricating oil composition having high density, low viscosity, and high flash point can be provided.

DESCRIPTION OF EMBODIMENTS

Hereinafter, the embodiments of the present invention will be described in detail. Besides, the present invention is not limited to the following embodiments, and the present invention may be arbitrarily modified and carried out unless it deviates from the spirit thereof.

The upper limit value and lower limit value of the numerical range described in the present description can be arbitrarily combined with each other. For example, if "A to B" and "C to D" are described, the ranges "A to D" and "C to B" are also encompassed as numerical ranges in the scope of the present invention. In addition, the numerical range "the lower limit value to the upper limit value" described in the present description means that the value is the lower limit value or more and the upper limit value or less, unless otherwise specified.

One embodiment of the present invention relates to a lubricating oil composition (hereinafter also referred to as a "composition") comprising the following components: (A) a base oil and (B) a fluorine compound, wherein the lubricating oil composition is characterized in that the base oil comprises a mineral oil, and in that the boiling point of the fluorine compound is in the range of 40° C. to 150° C. The composition according to the present embodiment further comprises, as necessary, (C) other additives. Hereinafter, individual components comprised in the composition according to the present embodiment will be successively described.

[Component (A): Base Oil]

The base oil comprises a mineral oil. As such a mineral oil, any given mineral oil can be appropriately selected from among mineral oils that are conventionally used as base oils for lubricating oils, and can be used. Examples of such a mineral oil many include: a mineral oil produced by subjecting an atmospheric residue obtained by the atmospheric distillation of a crude oil to vacuum distillation, and then subjecting the obtained lubricating oil fraction to one or more types of treatments such as solvent deasphalting, solvent extraction, hydrogenolysis, solvent dewaxing, contact dewaxing, and hydrogenation refining, so as to purify it; and a mineral oil produced by isomerizing wax or GTL WAX (gas to liquid wax). The mineral oil may be used alone or in combination of two or more types.

The base oil may consist only of a mineral oil, or may also be a combination of a mineral oil and a synthetic oil. From the viewpoint of densification of the lubricating oil composition, the lubricating oil composition comprises a mineral oil in an amount of preferably 60% by weight or more, more preferably 65% by weight or more, and particularly preferably 70% by weight or more, based on the weight of the base oil (100% by weight).

The synthetic oil used in combination of the mineral oil is not particularly limited, and any given synthetic oil can be appropriately selected from synthetic oils that are conventionally used as base oils for lubricating oils, and can be used. For example, from the viewpoint of solubility with respect to the after-mentioned fluorine compound, the synthetic oil is preferably at least one selected from a naphthenic compound, a polyolefin compound, an aromatic compound, an ether compound, an ester compound, and a glycol compound. The synthetic oil may be used alone or in combination of two or more types. Among others, from the viewpoint of obtaining a composition having low viscosity and high flash point, an ester compound is more preferably used.

The naphthenic compound may be preferably a compound having a ring selected from a cyclohexane ring, a bicycloheptane ring, and a bicyclooctane ring.

The polyolefin compound may be preferably an α-olefin homopolymer or copolymer (e.g. an ethylene-α-olefin copolymer, etc.), and a hydride thereof.

Examples of an alcohol (unit) constituting the ester compound may include monools such methanol, ethanol, n-propanol, n-butanol, n-pentanol, n-hexanol, n-heptanol, n-octanol, n-nonanol, n-decanol, n-undecanol, n-dodecanol, n-tridecanol, n-tetradecanol, oleyl alcohol, ethyl hexanol, butyl octanol, pentyl nonanol, hexyl decanol, heptyl undecanol, octyl dodecanol, methyl heptadecanol, oleyl alcohol, benzyl alcohol, 2-phenethyl alcohol, 2-phenoxy ethanol, ethylene glycol monobenzyl ether, ethylene glycol monophenyl ether, diethylene glycol monobenzyl ether, diethylene glycol monophenyl ether, phenol, cresol, xylenol or alkylphenol; ethylene glycol, diethylene glycol, triethylene glycol, polytetramethylene glycol, 1,3-propanediol, 1,4-butanediol, 1,5-pentanediol, 1,6-hexanediol, and polyethylene glycol (both-terminal hydroxyl groups), triols such as trimethylol propane or trimethylol ethane, and tetraols such as pentaerythritol. The alcohol (unit) may be used alone or in combination.

Examples of carboxylic acid (unit) constituting the ester may include: monocarboxylic acids, such as n-butanoic acid, n-pentanoic acid, n-hexanoic acid, n-heptanoic acid, n-octanoic acid, n-nonanoic acid, n-decanoic acid, n-undecanoic acid, n-dodecanoic acid, n-tridecanoic acid, n-tetradecanoic acid, ethylhexanoic acid, butyloctanoic acid, pentylnonanoic acid, hexyldecanoic acid, heptylundecanoic acid, octyldodecanoic acid, methylheptadecanoic acid, oleic acid, benzoic acid, toluic acid, phenylacetic acid, and phenoxyacetic acid; and dicarboxylic acids, such as adipic acid, azelaic acid, sebacic acid, 1,10-decamethylenedicarboxylic acid, phthalic acid, isophthalic acid, and terephthalic acid. The carboxylic acid (unit) may be used alone or in combination.

Preferred examples of the ester consisting of the aforementioned alcohol and carboxylic acid may include: polyglycol benzoic acid esters, such as polyethylene glycol dibenzoate and polypropylene glycol dibenzoate; linear carboxylic acid hindered esters, such as n-octanoic acid tetraester of pentaerythritol and n-octanoic acid triester of trimethylolpropane; diesters, such as di-n-octyl azelate and ethylhexyl 1,10-decamethylenedicarboxylate; monoesters, such as dodecyl 16-methylheptadecanoate and n-dodecyl 2-heptylundecanoate; and oleyl esters, such as oleyl oleate and 16-methylheptadecyl oleate.

Examples of the aromatic compound may include alkyl aromatic compounds, such as alkylbenzene and alkylnaphthalene.

An example of the ether compound may be polyphenyl ether.

Example of the glycol compound may include polyglycol oils such as polyoxyalkylene glycol.

The base oil is a main ingredient of the lubricating oil composition, and in general, the content of the base oil is preferably 60% to 97% by weight, more preferably 65% to 97% by weight, and further preferably 70% to 95% by weight, based on the total weight of the composition.

The kinematic viscosity of the base oil at 40° C. is 1 to 25 $mm^2/s$. When the kinematic viscosity of the base oil at 40° C. is 1 $mm^2/s$ or more, the efficiency of an oil pump is improved. When the kinematic viscosity of the base oil at 40° C. is 25 $mm^2/s$ or less, a composition having excellent cooling performance can be obtained. From the viewpoint of coolability, the kinematic viscosity of the base oil at 40° C. is more preferably 1 to 20 $mm^2/s$. The kinematic viscosity of the base oil at 40° C. may be, for example, in the range of 1 to 15 $mm^2/s$, or in the range of 1 to 10 $mm^2/s$, or in the range of 1 to 5 $mm^2/s$.

In the present description, the kinematic viscosity at a certain temperature means a value measured in accordance with JIS K2283: 2000.

The flash point of the base oil is not particularly limited. From the viewpoint of imparting excellent coolability to the lubricating oil composition, the flash point of the base oil is preferably 60° C. or higher. The flash point of the base oil is more preferably 65° C. or higher, and further preferably 70° C. or higher. As the flash point of the base oil increases, it is preferable. The base oil having no flash point is particularly preferable.

The flash point (PM) of the base oil is measured by a Pensky-Martens closed method (PM method) in accordance with JIS K 2265-3: 2007.

[Component (B): Fluorine Compound]

The fluorine compound is preferably a compound that is known to be, what is called, a fluorine refrigerant. Examples of the fluorine compound may include hydrochlorofluorocarbon (HCFC), hydrofluorocarbon (HFC), and hydrofluoroether (HFE). The fluorine compound having a boiling point that is in the range of 40° C. to 150° C. is preferable. When the boiling point of the fluorine compound is 150° C. or lower, the cooling performance of the lubricating oil composition is improved. When the boiling point of the fluorine compound is 40° C. or higher, vaporization at room temperature is prevented, and thus, both handlability and odor are improved. From the viewpoint of the improvement of the cooling performance of the lubricating oil composition, the boiling point of the fluorine compound is preferably 150° C. or lower, and more preferably 140° C. or lower. On the other hand, from the viewpoint of the stability of the lubricating oil composition, the boiling point of the fluorine compound is preferably 40° C. or higher, and more preferably 50° C. or higher. For example, the boiling point of the fluorine compound is preferably in the range of 40° C. to 150° C., and more preferably in the range of 50° C. to 140° C.

In one embodiment, the boiling point of the fluorine compound may be higher than 100° C. and 150° C. or lower, or 105° C. or higher and 150° C. or lower.

Examples of HCFC may include 3,3-dichloro-1,1,1,2,2-pentafluoropropane and 1,3-dichloro-1,1,2,2,3-pentafluoropropane. For example, ASAHIKLIN AK-225 manufactured by AGC Inc. is a mixture of these compounds, and the boiling point thereof is 54° C.

HFC is preferably a fluoride of alkane containing 4 to 12 carbon atoms. Examples of HFC may include $CF_3CHFCHFCF_2CF_3$ (boiling point: 55° C.) (manufactured by Dupont-Mitsui Fluorochemicals Co., Ltd., Vertrel XF), $CF_3CH_2CF_2CH_3$ (boiling point: 40° C.) (manufactured by Solvay Solexis S.p.A, SOLKANE 365 mfc), $C_5H_3F_7$ (boiling point: 82° C.) (manufactured by ZEON CORPORATION, ZEORORA HTA), 1,1,1,2,2,3,3,4,4,5,5,6,6-tridecafluorooctane ($CF_3CF_2CF_2CF_2CF_2CF_2CH_2CH_3$) (boiling point: 114° C.) (manufactured by AGC, ASAHIKLIN AC-6000), and 1,1,2,2,3,3,4-heptafluorocyclopentane (c-$CH_2CHFCF_2CF_2CF_2$) (HFC-c447ef) (boiling point: 82.5° C.).

Example of HFE may include $C_4F_9OCH_3$ (boiling point: 61° C.) (manufactured by 3M; Novec 7100), $C_4F_9OC_2H_5$ (boiling point: 76° C.) (manufactured by 3M; Novec 7200), $C_2F_5CF(OCH_3)C_3F_7$ (boiling point: 98° C.) (manufactured by 3M; Novec 7300), and $CHF_2CF_2OCH_2CF_3$(HFE-347pc-f) (boiling point: 56° C.).

The kinematic viscosity of the fluorine compound is not particularly limited. From the viewpoint of coolability, the kinematic viscosity of the fluorine compound at 25° C. is preferably 0.1 to 5 $mm^2/s$, more preferably 0.1 to 4 $mm^2/s$, and further preferably 0.1 to 3 $mm^2/s$.

The content of the fluorine compound is 3% to 30% by weight, based on the total weight of the composition. When the content of the fluorine compound is less than 3% by weight, coolability that can be imparted to the lubricating oil composition is not sufficient. When the content of the fluorine compound exceeds 30% by weight, the compatibility between the fluorine compound and the base oil is likely to deteriorate. When the compatibility between the fluorine compound and the base oil is poor, the fluorine compound tends to be precipitated in the lower part of the lubricating oil composition because it has a high density. If such a lubricating oil composition were used, the fluorine compound would stay in the lower part of the lubricating oil composition, so that the amount of the fluorine compound supplied to the cooling part would be decreased. Such a decrease in the supplied amount of the fluorine compound would cause a decrease in the cooling performance, or the amount of the fluorine compound supplied to the lubricating parts such as a gear wheel would become excessive, so that the lubricating performance (abrasion resistance) is likely to decrease.

From the viewpoint of compatibility, the content of the fluorine compound is more preferably 20% by weight or less, and further preferably 15% by weight or less. On the other hand, from the viewpoint of coolability, the content of the fluorine compound is more preferably 4% by weight or more, and further preferably 5% by weight or more. For instance, the content of the fluorine compound is more preferably 4% to 20% by weight, and further preferably 5% to 15% by weight.

[Component (C): Other Components]

The lubricating oil composition may comprise, as necessary, additives such as an anti-wear agent, an antioxidant, a viscosity index improver, a corrosion inhibitor, a metal deactivator, an antifoaming agent, and a detergent dispersant, in a range in which these additives do not inhibit the effects of the present invention.

The total content of these other components is not particularly limited, and it is, for example, approximately 0% to 20% by weight, based on the total weight of the composition.

(Anti-Wear Agent)

The anti-wear agent is not particularly limited, and any given anti-wear agent can be appropriately selected and used from among anti-wear agents that have been conventionally used in lubricating oils. For example, when an electric motor is used in combination with a gear speed reducer in hybrid vehicles or electric vehicles, in order not to damage electrical insulation as much as possible, it is preferable to use a neutral phosphorus compound, an acidic phosphorus acid ester or an amine salt thereof, a sulfur compound, and the like.

The content of the anti-wear agent is not particularly limited, and it is, for example, approximately 0.01% to 5% by weight, based on the total weight of the composition.

Examples of the neutral phosphorus compound may include: aromatic neutral phosphoric acid esters, such as tricresyl phosphate, triphenyl phosphate, trixylenyl phosphate, tricresylphenyl phosphate, tricresyl thiophosphate, and triphenyl thiophosphate; aliphatic neutral phosphoric acid esters, such as tributyl phosphate, tri-2-ethylhexyl phosphate, tributoxy phosphate, and tributyl thiophosphate; aromatic neutral phosphorus acid esters, such as triphenyl phosphite, tricresyl phosphite, trisnonylphenyl phosphite, diphenylmono-2-ethylhexyl phosphite, diphenylmonotridecyl phosphite, tricresyl thiophosphite, and triphenyl thiophosphite; and aliphatic neutral phosphorus acid esters, such as tributyl phosphite, trioctyl phosphite, trisdecyl phosphite, tris(tridecyl) phosphite, trioleyl phosphite, tributyl thiophosphite, and trioctyl thiophosphite. These neutral phosphorus compounds may be used alone, or may also be used in combination of two or more types.

Examples of the acidic phosphorus acid ester may include: aliphatic acidic phosphoric acid ester amine salts, such as di-2-ethylhexyl acid phosphate amine salt, dilauryl acid phosphate amine salt, and dioleyl acid phosphate amine salt; aliphatic acidic phosphorus acid esters and the amine salts thereof, such as di-2-ethylhexyl hydrogen phosphite, dilauryl hydrogen phosphite, and dioleyl hydrogen phosphite; aromatic acidic phosphoric acid ester amine salts, such as diphenyl acid phosphate amine salt and dicresyl acid phosphate amine salt; aromatic acidic phosphorus acid esters and the amine salts thereof, such as diphenyl hydrogen phosphite and dicresyl hydrogen phosphite; sulfur-containing acidic phosphoric acid ester amine salts, such as S-octylthioethyl acid phosphate amine salt and S-dodecylthioethyl acid phosphate amine salt; and sulfur-containing acidic phosphorus acid esters and the amine salts thereof, such as S-octylthioethyl hydrogen phosphite and S-dodecylthioethyl hydrogen phosphite. These acidic phosphorus acid esters may be used alone, or may also be used in combination of two or more types.

Various types of sulfur compounds can be used. Specific examples of the sulfur compound may include a thiadiazole compound, a polysulfide compound, a dithiocarbamate compound, a sulfurized oil-and-fat compound, and a sulfurized olefinic compound.

(Antioxidant)

As an antioxidant, any given antioxidant can be appropriately selected and used from among known antioxidants that have been conventionally used as antioxidants for lubricating oils. Examples of the antioxidant may include an amine-based antioxidant (diphenylamines and naphthylamines), a phenolic antioxidant, a molybdenum-based antioxidant, a sulfur-based antioxidant, and a phosphorus antioxidant. The antioxidant may be used alone as a single type, or in combination of two or more types. The content of the antioxidant is not particularly limited, and it is, for example, approximately 0.05% to 7% by weight, based on the total weight of the composition.

(Viscosity Index Improver)

Examples of the viscosity index improver may include polymethacrylate, dispersion type polymethacrylate, an olefinic copolymer (e.g. an ethylene-propylene copolymer, etc.), a dispersion type olefinic copolymer, and a styrene copolymer (e.g. a styrene-diene copolymer, a styrene-isoprene copolymer, etc.). The viscosity index improver may be used alone or in combination of two or more types. The amount of the viscosity index improver mixed is not particularly limited. For example, from the viewpoint of mixing effects, the amount of the viscosity index improver mixed is approximately 0.5% by weight or more and 15% by weight or less, based on the total weight of the composition.

(Corrosion Inhibitor)

Examples of the corrosion inhibitor may include fatty acid, alkenyl succinic acid half ester, fatty acid soap, alkylsulfonate salt, polyhydric alcohol fatty acid ester, fatty acid amide, oxidized paraffin, and alkyl polyoxyethylene ether. The corrosion inhibitor may be used alone or in combination of two or more types. The preferred amount of the corrosion inhibitor mixed is not particularly limited, and it is approximately 0.01% by weight or more and 3% by weight or less, based on the total weight of the composition.

(Metal Deactivator)

Examples of the metal deactivator may include benzotriazole, a triazole derivative, a benzotriazole derivative, and a thiadiazole derivative. The metal deactivator may be used alone or in combination of two or more types. The content of the metal deactivator is not particularly limited, and it is preferably 0.01% to 5% by weight, based on the total weight of the composition.

(Antifoaming Agent)

Examples of the antifoaming agent may include silicon compounds such as dimethylpolysiloxane, and polyacrylate. The antifoaming agent may be used alone or in combination of two or more types. The content of the antifoaming agent is not particularly limited, and it is approximately 0.01% by weight or more and 5% by weight or less, based on the total weight of the composition.

(Detergent Dispersant)

Examples of the detergent dispersant may include a succinimide compound, a boron imide compound, and an acid amide compound. The detergent dispersant may be used alone or in combination of two or more types. The content of the detergent dispersant is not particularly limited, and it is preferably 0.1% to 20% by weight, based on the total weight of the composition.

[Properties of Lubricating Oil Composition]

The lubricating oil composition preferably satisfies three cooling performances, namely, low viscosity, high density, and high flash point (or having no flash points).

From the viewpoint of the cooling performances, the kinematic viscosity of the lubricating oil composition at 40° C. is preferably 0.5 to 40 $mm^2/s$, more preferably 1 to 35 $mm^2/s$, and further preferably 1 to 30 $mm^2/s$.

From the viewpoint of the cooling performances, the kinematic viscosity of the lubricating oil composition at 100° C. is preferably 0.1 to 20 $mm^2/s$, more preferably 0.5 to 15 $mm^2/s$, and further preferably 0.5 to 10 $mm^2/s$.

From the viewpoint of the cooling performances, the density of the lubricating oil composition is preferably 0.75 $g/cm^3$ or more, more preferably 0.80 $g/cm^3$ or more, and further preferably 0.84 $g/cm^3$ or more. If the density of the lubricating oil composition is high, heat transfer coefficient is improved, and thus, coolability is improved. From the viewpoint of coolability, as the density increases, it is preferable. On the other hand, as the density increases, the solubility of the lubricating oil composition in mineral oil tends to decrease. Accordingly, from the viewpoint of compatibility, the density of the lubricating oil composition is preferably 1.25 $g/cm^3$ or less, more preferably 1.20 $g/cm^3$ or less, and further preferably 1.15 $g/cm^3$ or less. In one embodiment, the density of the lubricating oil composition is in the range of 0.85 to 1.25 $g/cm^3$, more preferably in the range of 0.855 to 1.20 $g/cm^3$, and further preferably in the range of 0.86 to 1.15 $g/cm^3$. In the present description, the density of the lubricating oil composition is measured in the environment of 15° C., in accordance with the method of JIS K 2249-1: 2011.

The flash point of the lubricating oil composition is preferably 60° C. or higher, more preferably 65° C. or higher, and further preferably 70° C. or higher. The flash point of lower than 60° C. is not preferable from the viewpoint of handling safety, and further, problems regarding odor easily occur. From the viewpoint of handling safety, as the flash point increases, it is preferable. The lubricating oil composition having no flash points is particularly preferable. In particular, in the case of electric vehicles and the like, the lubricating oil composition having no flash points is more desirable in terms of safety. The flash point (PM) of the lubricating oil composition was measured by a Pensky-Martens closed method (PM method) in accordance with JIS K 2265-3: 2007.

The lubricating oil composition is preferably excellent in terms of the compatibility between the base oil and the fluorine compound. The expression "be excellent in terms of the compatibility" is used to mean that precipitation of the fluorine compound does not occur in the present composition formed by mixing the base oil and the fluorine compound at a predetermined ratio. More specifically, it is preferable that precipitation of the fluorine compound do not occur at a temperature of 30° C., and it is more preferable that precipitation of the fluorine compound do not occur both at room temperature (25° C.) and at a temperature of 30° C. If such precipitation of the fluorine compound occurred, the fluorine compound would stay in the lower part of the lubricating oil composition, so that the amount of the fluorine compound supplied to the cooling part would be decreased. Such a decrease in the supplied amount of the fluorine compound would cause a decrease in the cooling performance, or the amount of the fluorine amount applied to the lubricating parts such as a gear wheel would become excessive, so that the lubricating performance (abrasion resistance) is likely to decrease. By using the lubricating oil composition that is excellent in terms of compatibility, the fluorine compound and the base oil can be homogeneously supplied to cooling parts or lubricating parts such as a gear wheel, and thus, sufficient cooling performance and lubricating performance can be imparted to them.

In one embodiment, the lubricating oil composition is not separated into phases, and it is homogeneous.

[Intended Use of Lubricating Oil Composition]

The aforementioned lubricating oil composition of the present invention has excellent cooling performances (e.g. high density, low viscosity, and high flash point), as well as lubricity. Hence, the present lubricating oil composition can be preferably used in the cooling of various types of apparatuses. In particular, the present lubricating oil composition is preferably used in the cooling of apparatuses for electrically driven vehicles, such as electric vehicles and hybrid vehicles. For example, the present lubricating oil composition is preferable as an oil for cooling at least one apparatus for electric vehicles, which is selected from among a motor, a battery, an inverter, an engine, and a transmission.

[Cooling Device]

The lubricating oil composition imparts lubricity and cooling effects to various types of apparatuses. For example, the lubricating oil composition is allowed to circulate through various types of apparatuses, such as apparatuses for electric vehicles, so that the lubricating oil composition cools the apparatuses, while giving lubrication to the apparatuses. In one embodiment, the present invention provides a cooling device for cooling apparatuses for electric vehicles, comprising the aforementioned lubricating oil composition of the present invention. For example, the present lubricating oil composition is used in a cooling device for cooling at least one apparatus for electric vehicles, which is selected from among a motor, a battery, an inverter, an engine, and a transmission. For example, the present lubricating oil composition can be used in a cooling device for a hydraulic system, a stationary transmission, an automotive transmission, a motor, or a battery.

[Method for Producing Lubricating Oil Composition]

The method for producing a lubricating oil composition of the present embodiment is not particularly limited. The method for producing a lubricating oil composition of one embodiment comprises mixing the component (A), the component (B), and as necessary, the component (C) with one another. The component (A), the component (B), and as necessary, the component (C) may be mixed with one another according to any method, and the order of mixing the components and the mixing method are not limited.

EXAMPLES

Hereinafter, the present invention will be described in detail with reference to the following examples. However, these examples are not intended to limit the technical scope of the present invention.

The physical properties of individual raw materials used in the following Examples and Comparative Examples and the lubricating oil compositions of individual Examples and individual Comparative Examples were measured according to the following methods.

(1) Kinematic Viscosity

In accordance with JIS K2283: 2000, using a glass capillary viscometer, the kinematic viscosity at 40° C. (40° C. kinematic viscosity), the kinematic viscosity at 100° C. (100° C. kinematic viscosity), and the kinematic viscosity at 25° C. (25° C. kinematic viscosity) were measured.

(2) Viscosity Index

Viscosity index was measured in accordance with JIS K2283: 2000.

(3) Density

The density at 15° C. was measured in accordance with JIS K2249-1: 2011.

(4) Flash Point

The flash point of a base oil was measured according to two types of methods.

The flash point (PM) was measured by a Pensky-Martens closed method (PM method) in accordance with JIS K 2265-3: 2007.

The flash point of a fluorine compound was measured by the PM method.

The flash point of a silicon oil was measured by the PM method.

The flash point of a lubricating oil composition was measured by the PM method.

Moreover, the miscibility of a lubricating oil composition in each of the following Examples and the following Comparative Examples was evaluated according to the following method.

(Evaluation of Miscibility)

The lubricating oil composition prepared in each of the Examples and Comparative Examples was intensively stirred using a stirrer, (a) at room temperature and (b) at 30° C., and was then left at rest for 5 minutes. Thereafter, the miscibility of the lubricating oil composition was evaluated in terms of the presence or absence of a precipitate, based on the following criteria.

A: A precipitate was not generated both (a) at room temperature (25° C.) and (b) at 30° C.

B: A precipitate was generated (a) at room temperature (25° C.), but such a precipitate was not generated at 30° C.

C: A precipitate was generated both (a) at room temperature (25° C.) and (b) at 30° C.

Examples 1 to 5 and Comparative Examples 1 to 6

Individual components shown in Table 1 were mixed with one another to prepare the lubricating oil compositions of Examples and Comparative Examples, and the properties and miscibility of the lubricating oil compositions were then evaluated according to the above-described methods.

TABLE 1

| | | Ex. 1 | Ex. 2 | Ex. 3 | Ex. 4 | Ex. 5 | Comp. Ex. 1 |
|---|---|---|---|---|---|---|---|
| Composition (% by weight) | Mineral oil 1 | 95.00 | 90.00 | 85.00 | 80.00 | 70.00 | 100.00 |
| | Mineral oil 2 | | | | | | |
| | Synthetic oil 1 | | | | | | |
| | Synthetic oil 2 | | | | | 20.00 | |
| | Silicon oil 1 | | | | | | |
| | Fluorine compound 1 | 5.00 | 10.00 | 15.00 | 20.00 | 10.00 | |
| | Total | 100.00 | 100.00 | 100.00 | 100.00 | 100.00 | 100.00 |
| Property/ Evaluation | 40° C. kinematic viscosity ($mm^2/s$) | 2.03 | 1.90 | 1.80 | | 1.85 | 2.10 |
| | 100° C. kinematic viscosity | 0.91 | 0.86 | 0.82 | — | 0.87 | 0.95 |

TABLE 1-continued

| | | | | | | |
|---|---|---|---|---|---|---|
| ($mm^2/s$) | | | | | | |
| Viscosity index | 27 | 17 | 7 | — | 41 | 47 |
| Density ($g/cm^3$) | 0.862 | 0.882 | 0.904 | — | 0.912 | 0.844 |
| Flash point (PM) (° C.) | No flash point | No flash point | No flash point | — | No flash point | 100 |
| Miscibility | A | A | A | B | A | — |

| | | Comp. Ex. 2 | Comp. Ex. 3 | Comp. Ex. 4 | Comp. Ex. 5 | Comp. Ex. 6 |
|---|---|---|---|---|---|---|
| Composition (% by weight) | Mineral oil 1 | 95.00 | | 95.00 | 95.00 | 50.00 |
| | Mineral oil 2 | 5.00 | | | | |
| | Synthetic oil 1 | | 95.00 | | | |
| | Synthetic oil 2 | | | 5.00 | | |
| | Silicon oil 1 | | | | 5.00 | |
| | Fluorine compound 1 | | 5.00 | | | 50.00 |
| | Total | 100.00 | 100.00 | 100.00 | 100.00 | 100.00 |
| Property/ Evaluation | 40° C. kinematic viscosity ($mm^2/s$) | 2.08 | 2.69 | 2.07 | 2.06 | — |
| | 100° C. kinematic viscosity ($mm^2/s$) | 0.93 | 1.12 | 0.93 | 0.97 | — |
| | Viscosity index | 41 | 63 | 40 | 81 | — |
| | Density (g/cm3) | 0.842 | 0.796 | 0.850 | 0.846 | — |
| | Flash point (PM) (° C.) | 99 | No flash point | 101 | 100 | — |
| | Miscibility | A | A | A | A | C |

Individual components shown in Table 1 are as follows.

Mineral oil 1: Mineral oil (40° C. kinematic viscosity: 2.10 $mm^2/s$, flash point (PM): 100° C.)

Mineral oil 2: Mineral oil (40° C. kinematic viscosity: 1.64 $mm^2/s$, flash point (PM): 80° C.)

Synthetic oil 1: Poly-α-olefin (40° C. kinematic viscosity: 2.77 $mm^2/s$, flash point (PM): 130° C.)

Synthetic oil 2: Ester compound (40° C. kinematic viscosity: 2.27 $mm^2/s$, flash point (PM): 128° C.)

Silicon oil 1: Silicon oil (25° C. kinematic viscosity: 2.0 $mm^2/s$, flash point (PM): 88° C.)

Fluorine compound 1: Hydrofluorocarbon (HFC) (1,1,1,2,2,3,3,4,4,5,5,6,6-tridecafluorooctane, 25° C. kinematic viscosity: 0.69 $mm^2/s$, flash point (PM): no flash point, boiling point: 114° C.)

As shown in Table 1, it was confirmed that the lubricating oil compositions of Examples 1 to 5, each comprising a mineral oil and a specific amount of fluorine compound, had low kinematic viscosity and high density, no flash point was present in these compositions, and further, the compositions were excellent in terms of miscibility (i.e. compatibility between the fluorine compound and the base oil).

In contrast, the lubricating oil compositions of Comparative Example 1, Comparative Example 2, Comparative Example 4, and Comparative Example 5, which did not comprise a fluorine compound, had low flash point and low density, and sufficient cooling performance could not be obtained from these compositions.

The lubricating oil composition of Comparative Example 3, in which a synthetic oil was combined with a fluorine compound, had a low density value, and sufficient cooling performance could not be obtained from this composition.

In the case of the lubricating oil composition of Comparative Example 6, comprising more than 30% by weight of a fluorine compound, miscibility was deteriorated, and precipitation of the fluorine compound occurred.

The scope of the present invention is not constrained by the above explanation, and thus, the present invention other than the above-described examples can be appropriately modified and performed in a range in which the spirit of the present invention is not impaired. It is to be noted that all documents and publications cited in the present description are incorporated herein by reference in their entirety, regardless of the purpose thereof. Moreover, the present description includes the contents as disclosed in the claims and the description of Japanese Patent Application No. 2020-004703 (filed on Jan. 15, 2020), which is a priority document of the present application.

INDUSTRIAL APPLICABILITY

The lubricating oil composition of the present invention has lubricity, is excellent in terms of cooling performance, and can be used in the cooling of apparatuses for electric vehicles such as electric vehicles or hybrid vehicles. The present lubricating oil composition is preferable, for example, as a lubricating oil for use in cooling at least one apparatus for electric vehicles that is selected from a motor, a battery, an inverter, an engine, and a transmission.

The invention claimed is:

1. A lubricating oil composition suitable for cooling an electric vehicle apparatus the composition comprising:

a base oil; and a fluorine compound, wherein the base oil comprises a mineral oil, wherein the base oil has a kinematic viscosity at 40° C. in a range of from 1 to 5 $mm^2/s$, and wherein the fluorine compound is present in a range of from 3 to 15 wt. %, based on total composition weight.

2. The composition of claim 1, wherein the base oil has a flash point of 60° C. or higher.

3. The composition of claim 1, wherein the base oil is a mineral oil.

4. The composition of claim 1, wherein 70% by weight or more of the base oil is a mineral oil.

5. The composition of claim 1, wherein the fluorine compound comprises a hydrochlorofluorocarbon, hydrofluorocarbon, hydrofluoroether, or a mixture of two or more of any of these.

6. The composition of claim 1, wherein the fluorine compound has a boiling point in a range of from 40° C. to 150° C.

7. An apparatus configured for an electric vehicle, the apparatus comprising the composition of claim 1.

8. A motor, a battery, an inverter, an engine, or a transmission of an electric vehicle, comprising the composition of claim 1.

9. A cooling device configured for an electric vehicle cooling apparatus, the device comprising the composition of claim 1.

10. The composition of claim 1, wherein the base oil is a combination of a mineral oil with at least one of synthetic oil selected from a naphthenic compound, a polyolefin compound, an aromatic compound, an ether compound, an ester compound, and a glycol compound.

11. The composition of claim 1, wherein the base oil comprises:

a mineral oil, and a naphthenic compound, a polyolefin compound, an aromatic compound, an ether compound, an ester compound, and/or a glycol compound.

12. A method of cooling an apparatus of an electric vehicle, the method comprising:

contacting the apparatus and the composition of claim 1.

13. The method of claim 12, wherein the apparatus is a motor, a battery, an inverter, an engine, or a transmission of the electric vehicle.

14. The composition of claim 1, having a kinematic viscosity at 40° C. in a range of from 1.80 to 5 $mm^2/s$.

15. The composition of claim 1, having a kinematic viscosity at 40° C. in a range of from 1.80 to 2.69 $mm^2/s$.

16. The composition of claim 1, having a kinematic viscosity at 40° C. in a range of from 1.80 to 2.03 $mm^2/s$.

17. The composition of claim 1, having a kinematic viscosity at 40° C. in a range of from 1 to 2.03 $mm^2/s$.

18. The composition of claim 1, wherein the fluorine compound is present in a range of from 5 to 15 wt. %, based on the total composition weight.

19. The composition of claim 16, wherein the fluorine compound is present in a range of from 5 to 15 wt. %, based on total composition weight.

20. The composition of claim 1, having a viscosity index in a range of from 7 to less than 40.

* * * * *